United States Patent [19]

Marbach

[11] 4,256,026

[45] Mar. 17, 1981

[54] MACHINE TOOL FOR STAMPING AND GROOVING

[75] Inventor: Karl Marbach, Heilbronn, Fed. Rep. of Germany

[73] Assignee: Firma Karl Marbach GmbH, Heilbronn, Fed. Rep. of Germany

[21] Appl. No.: 34,536

[22] Filed: Apr. 30, 1979

[30] Foreign Application Priority Data

Júl. 19, 1978 [DE] Fed. Rep. of Germany ..... 2831619

[51] Int. Cl.[3] ..... B31B 1/20

[52] U.S. Cl. ..... 493/404

[58] Field of Search ..... 93/58 R, 59 R

[56] References Cited

U.S. PATENT DOCUMENTS 4,112,827 9/1978 Kang ..... 93/59 R X

*Primary Examiner*—Robert D. Baldwin

*Attorney, Agent, or Firm*—Edwin E. Greigg

[57] ABSTRACT

A machine tool for stamping and grooving paperboard for forming folding blanks which includes a die plate of fiber-reinforced, hard paper provided with marginal edges, ribs and grooves formed by means of program-controlled tools and having alignment openings for receiving alignment pins, the die plate being adhesively secured to one of the machine stamping plates.

8 Claims, 4 Drawing Figures

MACHINE TOOL FOR STAMPING AND GROOVING

BACKGROUND OF THE INVENTION

The invention relates to a machine tool for stamping and grooving, used, particularly, in the manufacture of folding blanks made from sheets of cardboard, paperboard or the like, having a stamping die plate and a strip steel punch plate affixable on machine stamping plates capable of being moved toward each other. Plastic die plates are known which are produced, in accordance with the German Pat. No. 1,210,310, as follows: An engraved metal plate serves as the primary matrix, from which a punch plate made of thermoplastic material or a synthetic resin is produced. A series of die plates is produced, also from thermoplastic material or synthetic resin, by means of the above-mentioned primary matrix. These die plates, however, have the disadvantage that they are expensive to manufacture, do not have a long service life, and are greatly limited as to their capacity for maintaining accuracy as to gauge with fluctuations in temperature. In addition, it is difficult to obtain precise orientation of the die plate and the strip steel punch plate with respect to each other.

OBJECT AND SUMMARY OF THE INVENTION

The object of the invention is to provide a stamping and grooving machine tool which can be manufactured simply and precisely, which has a long service life, and which can be easily mounted.

In order to attain this object, the invention provides that the die plate is configured as a plate whose circumferential, marginal edges and whose grooves and ribs, intended to provide the fold lines in accordance with the contours and folds of the desired folding blank, are produced by means of program-controlled tools; the die plate is provided with alignment openings into which alignment pins of the strip steel punch plate can be introduced and, on one side, has an adhesive layer by means of which it can be fixed adhesively to one of the machine stamping plates. In this manner, as many entirely identical die plates as desired can be cut from one initial plate and then be oriented precisely to the strip steel punch plates. The substance used to make the die plates can be selected in such a manner that deviations from the correct measurements for the die plate and the punch plate caused by temperature factors can be quite substantially avoided. Because of the durability of the plates, high levels of piece production can be attained. The manufacture of the die plates and the precise mounting thereof onto the machine stamping plates can be accomplished with particular simplicity.

In a particularly advantageous fashion, the plate used for the die plate is made of hard paper (bakelized or laminated paper) whose underside opposite the grooves is provided with a reinforcement layer of glass or of metal. In other words, the material used is a molded laminated plastic, and in particular a phenoplast laminated material having paper as the resiniferous member. Glass fibers, in particular, serve as the reinforcement layer.

For cutting out and grooving the die plate, cutters are used in the form of milling cutters, especially end-milling cutters which in order to form the grooves may be of cylindrical shape with a perpendicular front face and in order to cut out the die plate along its intended contour, may have an oblique configuration, so that the rim of the plate is made oblique and the underside is then larger than the upper side. The separation or cutting out of the die plate is not performed completely, so as not to damage the seating of the initial plate; the very thin connection which remains is subsequently cut through or punched out. In an efficient manner, the initial plate is held clamped to the machine support by means of a vacuum. It has a thickness of less than 1 mm; the bottom of the groove is at a distance from the plate underside of less than 0.3 mm and preferably 0.1 mm. This very short distance permits clean impressions and as a result of the reinforcement layer, there is no need to fear tearing or damage caused by bending.

It is particularly advantageous that the adhesive layer be applied as a double-sided adhesive foil. The die plate thereby attached to the machine stamping plate is then ready for immediate use.

Like the circumferential marginal edge and the grooves or ribs, the alignment openings are also produced by means of a program-controlled tool so that great precision is attained. It is of particular advantage that the program control for the guidance of the tools in manufacturing the die plate can also be used for producing the slits and openings for the reception of the alignment pins in the manufacture of the punch plates, particularly when the slits in a base plate for introduction of the strip steel are produced by means of laser beams. The program control functions efficiently by way of a data carrier, which stores data from a process controller pertaining to the desired contour and grooving of the die plates; a numerical control, continuous path guide means is of particular advantage.

In accordance with a further characteristic of the invention, the alignment pins can be countersunk in the openings of the base plate of the punch plate. After the die plate has been placed on the machine stamping plate, the alignment pins are pushed, so that they do not come into contact with the product to be stamped. When a change of die plates is made, the pins can be returned to their working position again.

By the above method of producing the die plates and punch plates, it is assured that the contours of die plate and punch plate match perfectly; all the outer contours are congruent. Each contour, straight line, angle, arc path and the like recorded on the data carrier can be verified by the control means. When care is taken in the process, the die plates can be removed from the machine stamping plate and reused.

The invention will be better understood as well as further objects and advantages thereof become more apparent from the ensuing detailed description of a preferred embodiment taken in conjunction with the drawings.

DESCRIPTION OF THE PREFERRED EMBODIMENT

Figure 1:
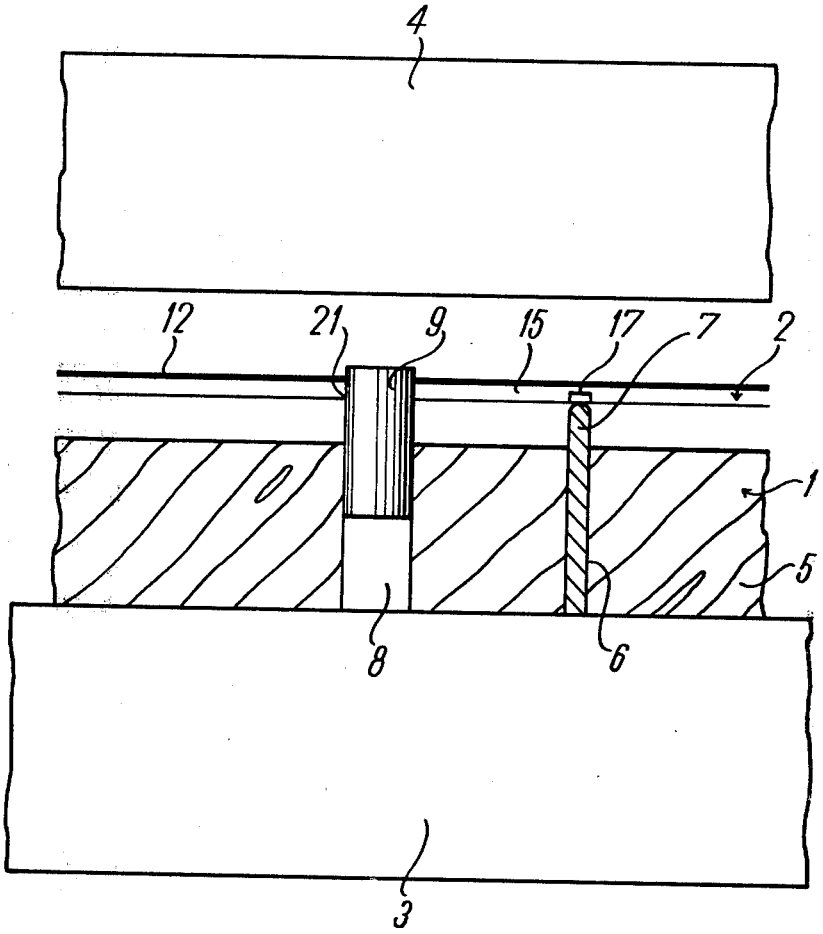
FIG. 1 is a section view through a stamping and grooving machine tool along with the machine stamping plates.
Figure 2:
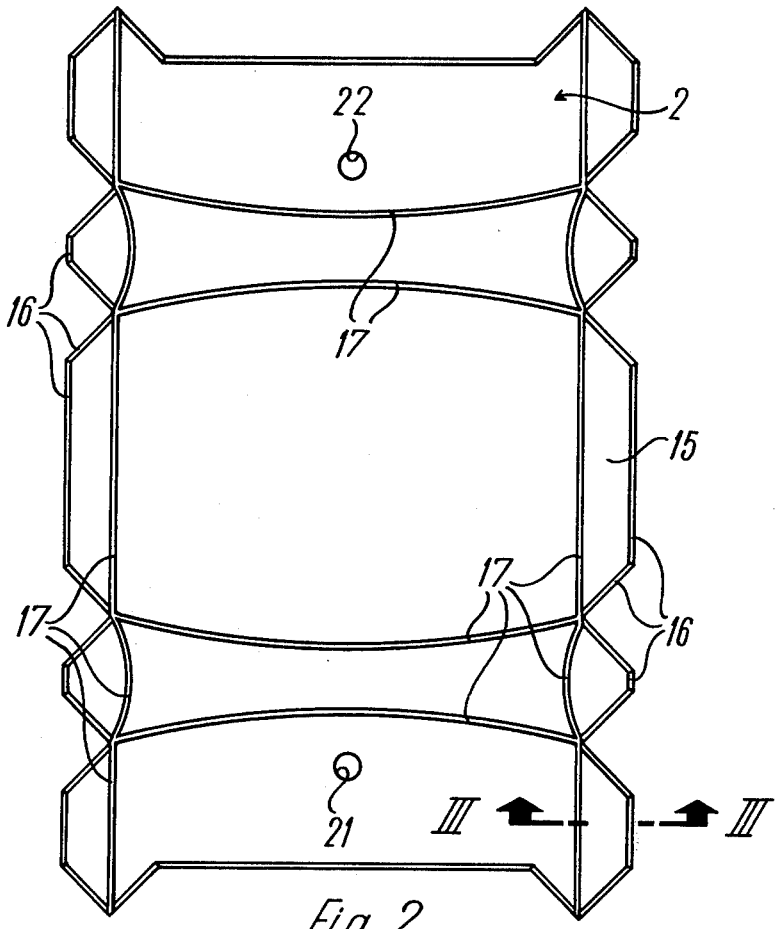
FIG. 2 is a plan view of a die plate.

The machine tool of the invention comprises a strip steel punch plate 1 (stamping mold) and a die plate 2. The strip steel punch plate 1 is secured to one machine stamping plate 3 and is locked into a locking frame, not shown in further detail. The die plate 2 is made to adhere to the opposite machine stamping plate 4.

The strip steel punch plate 1 has a base plate 5 which, as a rule, is made of plywood. By means of laser beams, slits 6 are formed in this base plate 5 into which the strip steel 7 is received. The strip steel 7 is rounded on its protruding front face in order to form grooves by impression and has a knife edge in order to cut the contours. The laser is guided in producing the slits 6 by a numerical-control, continuous path guide means. Further, the laser is also used to form through openings 8 into which alignment pins 9 are introduced.

Figure 3:
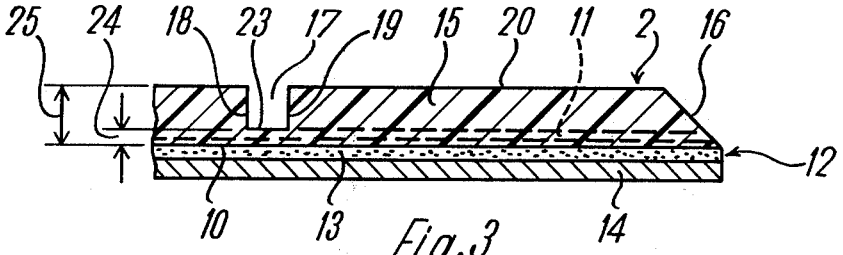
FIG. 3 is an enlarged partial sectional view of the die plate taken along the line III—III of FIG. 2.
Figure 4:
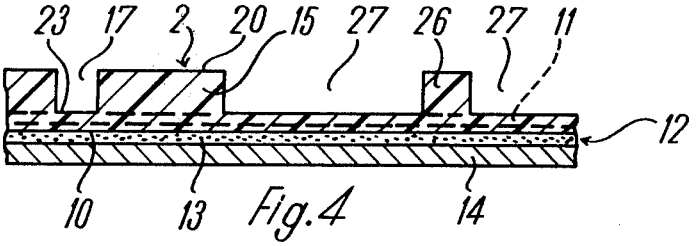
FIG. 4 is an enlarged partial sectional view through a different die plate.

The die plate 2 comprises hard paper (bakelized or laminated) and known under the trade name Pertinax which is provided on its underside 10, as shown in FIGS. 3, 4, with a reinforcement layer 11 (of glass fibers or metal). Placed on the underside 10 is an adhesive layer 12 in the form of a double-face adhesive foil 13, which is at first covered by a protective paper 14, the side of which, oriented toward the adhesive, is siliconized. Thus the die plate 2 forms a smooth plate 15, which is cut out from a larger initial plate, which is not shown. This cutting operation is performed by a milling tool, namely an end-milling cutter having a conical shape. To this end, the initial plate is clamped on the machine table, and may be held by suction created by a vacuum. The milling cutter, like the laser in producing the strip steel punch plate 1, is guided by a numerical-control, continuous path guide means, so that there is congruence with the laser shape. Because of the conical shape of the milling cutter, the rim 16 is made oblique. In order not to damage the machine table, the mill cutting at the contours is not performed completely through to the underside 10, but rather a very thin connection remains, which is subsequently cut off or punched out.

By means of a second, cylindrical end-milling cutter having a perpendicular front face, grooves 17 are milled in, which are U-shaped in cross-section as a result of the shape of the milling cutter; thus, their sides 18, 19 run perpendicular to the upper side 20 of the die plate 2. The grooves 17 lie opposite the corresponding strip steel 7 acting as the grooving tool and are necessary to attain a clean grooving of the product to be stamped. The milling cutter for the grooves 17 is also program controlled, as is the tool by means of which at least two alignment openings 21, 22 are made in the plate 15. The bottom 23 of the groove 17 is at a distance 24 from the underside 10, for example, 0.1 mm, with a plate thickness 25 of 0.6 mm. The adhesive foil 13, without the protective paper 14, has a thickness of 0.05 mm.

In addition to grooves 17, ribs 26 can also be formed in the plate 15, being created by means of corresponding milled-out areas 27. By means of the grooves 17, positive grooves are formed in the product to be stamped, while by means of the ribs 26, negative grooves are formed in the product.

The introduction of the machine tool into the machine is performed as follows:

First, the strip steel punch plate 1 is locked onto the machine stamping plate 3 in the locking frame. Then the die plate 2 is placed onto the alignment pins 9 located in the strip steel punch plate 1, so that the adhesive layer 12, from which the protective paper 14 has first been removed, faces toward the machine stamping plate 4. Then the machine stamping plates 3, 4, under reduced pressure, are driven together and then separated again. In so doing, the die plate 2 adheres to the machine stamping plate 4. The alignment pins 9 are pushed back into their through openings 8 when the plates 3, 4 are driven together, and they remain in this retracted position in the base plate 5 during the entire stamping procedure. The pins 9 and the base plate 5 are dimensioned such that there is sufficient space for the pins 9 to remain in the base plate 5 out of contact with the product to be stamped.

In order to obtain entirely uniform adhesion, a rubber plate is placed between the stamping plates 3, 4; if the plates are driven together again, uniform adhesion is assured. At this time, the operational procedure can begin immediately. A first sheet of cardboard, paperboard or the like is permitted to enter the work area and pressure is applied. After the sheet exits the work area, the product is examined to determine whether the cardboard is correctly stamped; if not, appropriate corrections are made. When a second sheet has been stamped, an examination is made as to whether the respective cutting lines and groove lines are correctly placed.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A stamping and grooving tool for producing folding blanks from sheets of cardboard, paperboard or the like, having a stamping die plate and a strip steel punch plate, which can be fixed on machine stamping plates movable relative to one another, comprising:

(a) a stamping die plate including a circumferential marginal edge and grooves and/or ribs for forming folding grooves in a folding blank;

(b) said die plate including alignment openings or through openings formed therein;

(c) said die plate comprising an adhesive layer on one side with which said die plate can be secured to one machine stamping plate;

(d) said strip steel punch plate including slits for receiving strip steel tools and through openings for receiving alignment pins having a length which differs from said strip steel tool;

said grooves in said stamping die plate mating with said strip steel tools and said alignment openings matching said alignment pins in said strip steel punch plate for aligning said stamping die plate and forming grooves in said folding blanks.

2. A tool as defined by claim 1, wherein said stamping die plate is formed of hard paper and has a thickness which is less than 1 mm, and the bottom of said groove is at a distance from its underside of less than 0.3 mm.

3. A tool as defined by claim 1, wherein said grooves of said die plate forms positive grooves in a blank and includes ribs for forming negative grooves.

4. A tool as defined by claim 1, wherein said die plate includes a bevelled rim and as a result the underside is larger than the upper side and said grooves are U-shaped in cross section such that the upright sides of the grooves are directed at least approximately at right angles to the upper side of the die plate.

5. A tool as defined by claim 1, wherein said alignment pins are countersunk into the through openings of the base plate.

6. A machine tool in accordance with claim 1 wherein said die plate is formed of hard paper and a reinforcement layer on the underside of said die plate opposite said grooves.

7. A machine tool in accordance with claim 6 wherein the thickness of said die plate is less than 1 mm.

8. A machine tool in accordance with claim 1 wherein said adhesive layer comprises a double-sided adhesive foil.

* * * * *